United States Patent [19]

Biedermann et al.

[11] 4,364,147

[45] Dec. 21, 1982

[54] APPARATUS FOR REMOVING PARTICLES OF DUST FROM THE SURFACES OF FLAT OBJECTS

[75] Inventors: Ernst Biedermann, Taufkirchen; Heinz Rapp, Munich, both of Fed. Rep. of Germany

[73] Assignee: Agfa-Gevaert AG, Leverkusen, Fed. Rep. of Germany

[21] Appl. No.: 188,678

[22] Filed: Sep. 19, 1980

[30] Foreign Application Priority Data

Sep. 26, 1979 [DE] Fed. Rep. of Germany ..... 2938863

[51] Int. Cl.[3] ..... A47L 5/14

[52] U.S. Cl. ..... 15/404; 15/316 R; 15/405

[58] Field of Search ..... 15/306 R, 306 A, 306 B, 15/308, 309, 316 R, 404, 405

[56] References Cited

U.S. PATENT DOCUMENTS

| | | | |
|---|---|---|---|
| 2,967,119 | 1/1961 | Gutterman | 15/306 A X |
| 3,137,882 | 6/1964 | Blanchard | 15/404 X |
| 3,420,710 | 1/1969 | Wollman | 15/306 A X |
| 3,668,008 | 6/1972 | Severynse | 15/306 A X |
| 4,197,610 | 4/1980 | Schneider | 15/404 X |
| 4,207,650 | 6/1980 | Crise | 15/404 |
| 4,244,078 | 1/1981 | Hughes et al. | 15/306 A X |
| 4,315,344 | 2/1982 | Woodward et al. | 15/404 X |

*Primary Examiner*—Chris K. Moore

*Attorney, Agent, or Firm*—Kontler, Grimes & Battersby

[57] ABSTRACT

Apparatus for removing dust from the flat surfaces of stationary or moving sheets, webs, plates or similar objects has a unit which converts a low-pressure laminar air stream into a pulsating air stream. The pulsating stream contacts the surface of an object simultaneously with ultrasonic radiation. The direction of flow of the pulsating air stream, which can be ionized, may be parallel with or at right angles to the direction of propagation of ultrasonic radiation.

18 Claims, 3 Drawing Figures

APPARATUS FOR REMOVING PARTICLES OF DUST FROM THE SURFACES OF FLAT OBJECTS

BACKGROUND OF THE INVENTION

The present invention relates to apparatus for removing dust and/or other impurities from the surfaces of substantially flat objects. More particularly, the invention relates to improvements in apparatus for contact-free removal of dust or similar impurities from substantially planar surfaces of stationary or moving objects, especially flexible objects such as photographic films, photographic prints, webs of paper or textile material, strips or sheets of synthetic plastic or metallic material and the like. In addition to the just mentioned presently preferred uses of the improved apparatus, the latter can be used with equal advantage for removal of dust or other impurities from rigid or semirigid objects such as glass panes, mirrors, sheet- or plate-like filters and the like. Still more particularly, the invention relates to apparatus for removing solid impurities from the surfaces of substantially flat flexible or rigid objects, such as running webs of photosensitive material or stiff filters, by resorting to one or more streams of a gaseous fluid, particularly air.

In photographic copying and enlarging apparatus, particles of dust which adhere to the surfaces of originals are likely to affect the quality of images of originals on photographic paper or other suitable photosensitive material. Therefore, photographic copying and/or enlarging apparatus are normally provided with means for removing dust and/or other foreign matter from the surfaces of originals prior to exposure of originals to copying light. For example, German Offenlegungsschrift No. 1,497,401 discloses an apparatus wherein a source of compressed air discharges an air stream at an angle of less than 90 degrees against the surface of a web of flexible material (such as, for example, a strip of exposed and developed photographic film) which is transported through a copying machine. In accordance with the proposal in the just-mentioned German publication, the air stream impinges upon a concave surface of the running web. Therefore, the apparatus of the German publication cannot be used for adequate treatment of rigid or reasonably rigid bodies, such as mirrors, many types of filters for photographic light, opaque, transparent or translucent glass panes and the like. Moreover, it is often difficult (if not impossible) to adequately bend a flexible body (such as a strip or web of photographic material) in such a way that the surface which is to be cleaned by the air stream exhibits a desired or optimum degree of concavity. It was further found that conventional apparatus of the type disclosed in the German publication cannot satisfactorily remove all traces of dust or similar foreign matter. In order to provide an at least partly satisfactory cleaning action, apparatus of the just-described character must embody a source of compressed air which is capable of directing the air stream with a substantial force, i.e., the pressure of the air stream must be quite pronounced in order to ensure the removal of sufficient quantities of particulate matter from one or both surfaces of a web, strip or the like. The utilization of sources of highly compressed air contributes to the initial and maintenance cost of conventional apparatus and the operation of such apparatus invariably involves the generation of readily detectable noise which is bothersome and is likely to affect the productivity of the attendants.

OBJECTS AND SUMMARY OF THE INVENTION

An object of the invention is to provide a novel and improved apparatus which can satisfactorily remove dust and/or other foreign matter from the surfaces of substantially flat objects even though such apparatus need not resort to one or more sources of highly compressed gaseous fluid.

Another object of the invention is to provide an apparatus of the just outlined character which is surprisingly simple and compact, which can be readily installed in existing photographic copying and/or enlarging machines, whose energy requirements are low, and which is more effective than heretofore known apparatus which are utilized for the same or similar purpose.

An additional object of the invention is to provide an apparatus which generates little noise, which can be put to use for extended periods of time, and which requires a minimum of attention when in actual use.

Still another object of the invention is to provide an apparatus of the above outlined character which can be readily designed in such a way that it occupies space which is available in an existing photographic copying, enlarging or like machine wherein particles of dust or other solid matter must be removed from one or both surfaces of one or more substantially flat objects in order to ensure adequate reproduction of images of or satisfactory transfer of images onto such objects.

Another object of the invention is to provide an apparatus which can readily remove particles of dust from curved or flat surfaces and which can be used for removal of impurities from rigid, semirigid and/or flexible bodies including plates, panes, slabs, foils, strips, webs and/or sheets.

An ancillary object of the invention is to provide novel and improved means for converting a laminar stream of air into a flow which can effectively disengage foreign matter from the surface of a substantially flat object even if such foreign matter adheres to the surface with a substantial force.

Still another object of the invention is to provide an apparatus of the above outlined character which requires a minimum of attention when in actual use, which can forcibly separate particles of foreign matter adhering to one or both surfaces of the object to be treated even though its parts do not contact the particles, and which can simultaneously treat one or more discrete objects depending on the orientation and/or direction of transport of objects past the treating or dust-removing station.

The apparatus of the present invention serves for removal of particles of dust or similar contaminants from the surface of a substantially flat object, for example, a stationary plate or sheet or a running web or strip of flexible material. The apparatus comprises means for generating a pulsating air stream, and means for contacting the surface of the object with the pulsating air stream. The stream generating means can comprise a flow generator (for example, a conventional blower) which is arranged to establish a substantially laminar air stream, and means for converting the laminar into the pulsating stream. The contacting means may comprise a nozzle having an intake end for entry and a second end for the discharge of the pulsating air stream.

The apparatus preferably further comprises a source of sonic or ultrasonic radiation which serves to direct such radiation against the surface of the object while the surface is contacted by the pulsating air stream. The direction of propagation of the air stream can be substantially parallel to the direction of propagation of ultrasonic radiation against the surface of the object. Alternatively, the source of ultrasonic radiation can direct such radiation substantially at right angles to the surface of the object while the aforementioned nozzle directs the pulsating air stream at an angle of approximately 90 degrees to the direction of propagation of ultrasonic radiation.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
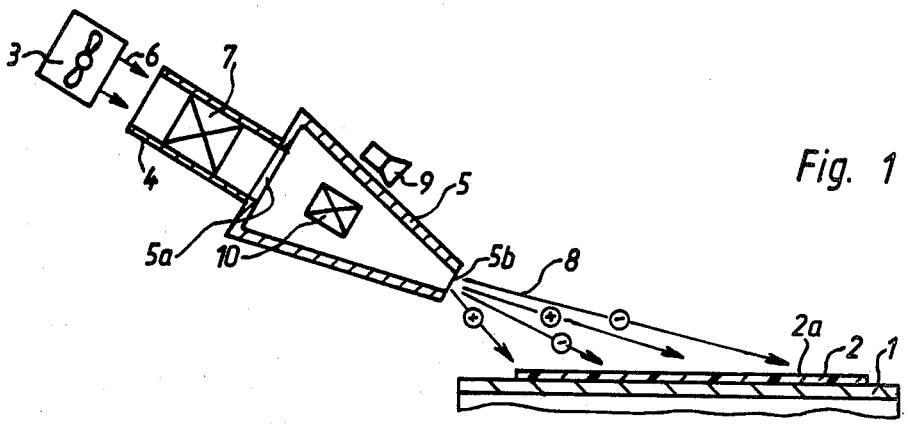
FIG. 1 is a schematic longitudinal vertical sectional view of an apparatus which embodies one form of the invention.
Figure 2:
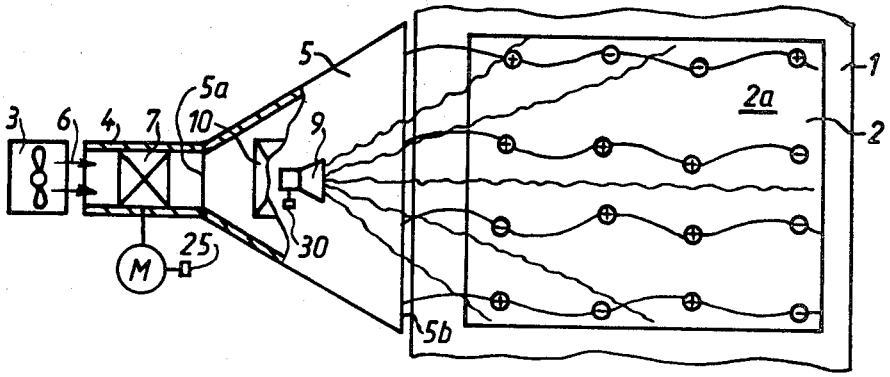
FIG. 2 is a plan view of the apparatus which is shown in FIG. 1, with certain parts shown in a horizontal sectional view.

Referring first to FIGS. 1 and 2, there is shown an apparatus which can remove dust or other solid impurities or droplets from the exposed upper surface 2*a* of a relatively flat object 2. The underside of the object 2 rests on the top surface of a horizontal table or an analogous supporting device 1. It is assumed that the object 2 is stationary during treatment in accordance with the present invention.

The improved apparatus includes a number of component parts which are located at a level above and to the left of the supporting device 1, as viewed in FIG. 1. Such component parts include an air flow generator 3 which is a conventional blower and directs a laminar air stream 6 toward the intake end of an elongated air duct 4 which contains a flow converting unit 7 serving to transform the laminar air stream 6 into a pulsating air stream 8 flowing toward and into the inlet or intake end 5*a* of a nozzle 5. The discharge end or outlet 5*b* of the nozzle 5 resembles a narrow slit which extends transversely of and along the full width of the object 2 (see FIG. 2) and discharges the pulsating air stream 8 against the exposed surface 2*a* of the object 2 on the supporting device 1. The nozzle 5 can be said to constitute a means for contacting the surface 2*a* with the pulsating air stream 8.

The converting unit 7 may include a propeller blade or flap (not specifically shown) which is installed in the duct 4 (the latter may constitute an elongated tube) and is driven by a suitable motor M so as to convert the laminar air stream 6 into the pulsating air stream 8. The arrangement may be such that the propeller blade of the converting unit 7 completely seals the corresponding portion of the passage in the duct 4 in one angular position and completely or nearly completely exposes such passage in another angular position thereof. Such mode of driving the propeller blade imparts to the originally laminar stream 6 a substantially sinusoidal pressure characteristic. The motor M for the propeller blade of the converting unit 7 is optional because the blade can be driven by the inflowing laminar air stream 6.

In accordance with one presently preferred embodiment of the invention, the direction of flow of pulsating air stream 8 against the surface 2*a* is such that it makes an oblique angle with the plane of the surface 2*a*, particularly an acute angle of between 20 and 35 degrees, most preferably an angle of approximately 30 degrees. As shown in FIG. 2, the width of the outlet 5*b* of the nozzle 5 at least equals the width of the object 2 on the supporting device 1. It is normally preferred to use a nozzle with an outlet 5*b* which is wider than the average object to be treated; this enables the improved apparatus to treat a variety of objects including relatively narrow running webs or strips as well as relatively wide plates, panes or sheets.

The apparatus of FIGS. 1 and 2 further comprises a suitable source 9 of ultrasonic radiation which is adjacent to and located at a level above the top panel of the nozzle 5. The source 9 directs ultrasonic radiation in substantial parallelism with the direction of flow of pulsating air stream 8 toward the exposed surface 2*a* of the object 2 on the supporting device 1. if desired, the source 9 can be replaced with a source of sonic radiation (not shown). However, a source of ultrasonic radiation is preferred at this time. The construction of the source 9 is preferably such that radiation which issues therefrom covers the entire exposed surface 2*a* of the object 2.

In accordance with a further feature of the apparatus which is shown in FIGS. 1 and 2, the nozzle 5 contains an air ionizing device 10 of any known design which ionizes the pulsating air stream 8 before the latter issues by way of the outlet 5*b*. An advantage of the ionizing device 10 is that, when the pulsating stream 8 containing an ionized gaseous fluid collides with statically charged dust particles on the surface 2*a* of the object 2, the particles are electrically neutralized so that the electrostatic force which causes the particles to adhere to the surface 2*a* is reduced or eliminated. This further facilitates the removal of dust particles from the surface 2*a* by resorting to an air stream whose pressure is surprisingly low and which is generated by a practically noiseless blower or fan.

Figure 3:
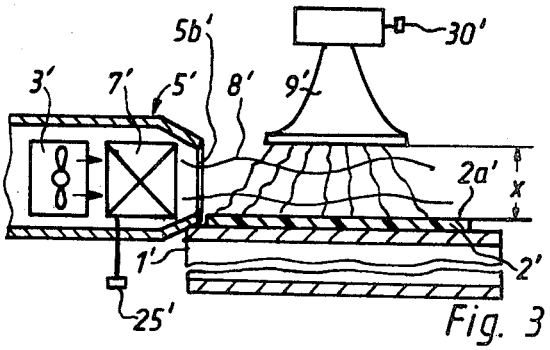
FIG. 3 is a fragmentary partly elevational and partly longitudinal vertical sectional view of a modified apparatus.

FIG. 3 illustrates a portion of a modified apparatus wherein the source 9' discharges or emits ultrasonic radiation substantially at right angles to the surface 2*a'* of the object 2' on the supporting means 1'. The object 2' is assumed to constitute an elongated web which travels in a direction at right angles to the plane of FIG. 3 and the supporting means 1' is a driven or idler roller. The remaining parts of the apparatus of FIG. 3 are constructed and assembled in such a way that the pulsating air stream 8' flows substantially at right angles to the direction of propagation of ultrasonic radiation issuing from the source 9'. The flow converting unit 7' of FIG. 3 is installed in the interior of the nozzle 5', the same as the generator 3' of the laminar air stream. It will be noted that the direction of flow of the pulsating air stream 8' is substantially parallel to the exposed surface 2*a'* of the running web 2'.

By the simple expedient of installing the source 9' at a predetermined distance x from the surface 2a' of the web 2', which distance is in a predetermined relationship to wavelength of the ultrasonic radiation (for example, 2 lambda), one can readily remove relatively large and heavy particles of dust, such as those particles whose dimensions equal or even exceed the dimensions and/or weight of sand kernels. Ultrasonic radiation issuing from the source 9' creates turbulence which causes the relatively heavy and/or large particles of dust to rise above and away from the surface 2a' so that such particles can be readily carried away by the pulsating air stream 8' issuing from the outlet 5b' of the nozzle 5'. If the wavelength is approximately ½ lambda, the particles on the surface 2a' of the web 2' are subjected to suction so that they are lifted off the surface 2a' and can be readily transported away by the transverse component of the pulsating air stream 8' issuing from the nozzle 5'.

An important advantage of the improved apparatus is that it can employ an extremely simple and inexpensive air flow generator 3 or 3' which can cause the formation of a laminar air stream having a pressure of not more than one-hundredth of one atmosphere above atmospheric pressure (or even nearer to atmospheric pressure). The versatility of the improved apparatus can be enhanced by utilizing an adjustable air flow converting unit which can vary the amplitude and/or frequency of the pulsating air stream 8 or 8'. This renders it possible to readily and rapidly select the desired characteristics of the air stream 8 or 8' for removal of foreign matter from different types of objects.

It is clear that the ionizing device 10 need not necessarily be installed in the interior of the nozzle 5. However, the placing of ionizing device 10 in the nozzle 5 contributes to compactness of the improved apparatus and reduces the number of necessary parts (e.g., by eliminating the need for a bracket which would be necessary to support an independent ionizing device outside of the nozzle 5). It goes without saying that a similar ionizing device can be provided in the apparatus of FIG. 3; such device can be placed immediately downstream of the converting unit 7'.

The provision of a nozzle with a relatively wide outlet 5b or 5b' is desirable and advantageous on the previously explained ground as well as on the additional ground that the pulsating air stream 8 or 8' covers the entire exposed surface 2a or 2a' so that it constitutes a curtain or barrier between such surface and the particles of dust which tend to descend onto the surface 2a or 2a' while the improved apparatus is in use.

As explained above, the improved apparatus can be used with advantage in photographic copying and/or enlarging machines as well as in other machines wherein flexible or partly flexible sheets or webs of photosensitive material are to be relieved of dust particles preparatory to exposure to copying light, either for the purpose of transferring their images onto photosensitive material or for reception of images from originals. In such machines, the utilization of an air flow generator (3 or 3') which discharges an air stream at an extremely low pressure is of particular importance because such low-pressure air stream is highly unlikely to displace the original or the photosensitive material from the predetermined plane in which the object is to be held in order to ensure the making of sharp reproductions. The reason for such retention of the object in the preferred plane is that the maximum amplitude of air pressure within the pulsating air stream 8 or 8' is or can be less than the constant air pressure of a laminar stream which is used in heretofore known apparatus.

In accordance with a further important and advantageous feature of the invention, and as already mentioned hereinbefore, the apparatus is or can be constructed and assembled in such a way that the amplitude and/or frequency of the pulsating air stream 8 or 8' and/or the frequency of ultrasonic radiation issuing from the source 9 or 9' can be adjusted in order to match or approximate the characteristic frequency of the object 2 or 2'. This excites the object and enables the object to shake loose any particles which adhere to the surface 2a or 2a' with a relatively large force. By way of example, FIG. 2 shows a handle 25 which can be used to adjust the RPM of the motor M in the converting unit 7 so that the latter can vary the frequency of pulsation of the stream 8. Handle 30 (also shown in FIG. 2) is used to adjust the sound frequency of radiation issuing from the source 9. As stated above, the frequency can be selected in such a way that it matches the characteristic frequency of the object 2. This enables the object to become separated from foreign particles which are then readily removed by the stream 8. Similar observations apply for the embodiment of FIG. 3. The handles for adjustment of the converting unit 7' and source 9' are respectively shown at 25' and 30'.

The highly satisfactory cleaning action of the improved apparatus is attributed to formation of the pulsating air stream 8 or 8'. The pressure of this air stream has crests or maxima alternating with minima or valleys. The pressure at the crests is relatively high, normally higher than the pressure of a laminar air stream. On the other hand, suction prevails in the valleys so that the particles of dust which adhere to the surface 2a or 2a' are subjected to the action of a dynamic flow which causes their separation from the surface 2a or 2a' and convenient removal by the stream 8 or 8'.

As mentioned before, the converting unit 7 or 7' can cooperate with a blower which furnishes a low-pressure laminar air stream. For example, the air flow generator 3 or 3' can constitute a conventional fan. It has been found that the laminar air flow which is generated by such fan is amply sufficient to satisfy the requirements of a copying or like machine, namely, to ensure adequate removal of foreign matter from the surface 2a or 2a' of a relatively flat object 2 or 2' which is about to be exposed to copying light. An advantage of a conventional fan or a similar low-pressure air flow generating device is that the device produces a minimum of noise which could be bothersome to attendants in a copying plant.

The combination of pulsating air stream 8 or 8' with ultrasonic radiation issuing from the source 9 or 9' exhibits additional important advantages. For example, particles which are so small as to offer insufficient resistance to the flow of air or which adhere to the surface 2a owing to their tacky nature (for example, the contaminants may constitute particles of fat) can be readily removed when subjected to the combined action of ultrasonic radiation and a pulsating air stream. Ultrasonic radiation contributes to separation of such particles from the surface 2a or 2a', and the thus separated particles are then readily removed by the pulsating air stream 8 or 8'. Particles which offer insufficient resistance to the flow of pulsating air stream 8 or 8' include particles which cannot be satisfactorily acted upon by the pulsating air stream alone, e.g. because their crosssectional area is very small but can be readily removed by the pulsating air stream 8 or 8' as soon as they are detached from the surface 2a or 2a' under the action of ultrasonic radiation.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for removing particles of dust or similar contaminants from the surface of a substantially flat object, comprising means for generating a pulsating air stream; means for contacting the surface of the object with the pulsating air stream; and a source of ultrasonic radiation arranged to direct such radiation against the surface of the object while the surface is contacted by the pulsating air stream.

2. The apparatus of claim 1, wherein said stream generating means comprises a flow generator arranged to establish a substantially laminar air stream and means for converting the laminar stream into the pulsating stream.

3. The apparatus of claim 2, wherein said contacting means comprises a nozzle having an intake end for entry and a second end for discharge of the pulsating air stream.

4. The apparatus of claim 1, wherein said means for contacting means includes nozzle means arranged to convey the pulsating air stream in substantial parallelism to the direction of propagation of ultrasonic radiation against the surface of the object.

5. The apparatus of claim 4, further comprising means for supporting the object so that the surface of the object is maintained in a predetermined plane, said direction making an oblique angle with said plane.

6. The apparatus of claim 5, wherein said angle is an acute angle.

7. The apparatus of claim 6, wherein said angle is between 20 and 35 degrees.

8. The apparatus of claim 7, wherein said angle is approximately 30 degrees.

9. The apparatus of claim 1, wherein the direction of propagation of ultrasonic radiation is substantially normal to the surface of the object.

10. The apparatus of claim 9, wherein the direction of propagation of the pulsating air stream is substantially normal to the direction of propagation of ultrasonic radiation.

11. The apparatus of claim 9, further comprising means for maintaining the surface of the object in a predetermined plane, the distance between said source of ultrasonic radiation and said plane being ½ lambda wherein lambda is the wavelength of ultrasonic radiation.

12. The apparatus of claim 1, wherein said contacting means includes nozzle means arranged to direct the pulsating air stream along a path which is substantially parallel and adjacent to the surface of the object.

13. The apparatus of claim 1, wherein said generating means comprises means for converting a laminar air stream into the pulsating stream, and means for adjusting said converting means so that the frequency of pulsation of the pulsating air stream is in a predetermined relation to the characteristic frequency of the material of the object.

14. The apparatus of claim 1, further comprising means for adjusting said source so that the frequency of ultrasonic radiation is in a predetermined relation to the characteristic frequency of the material of the object.

15. The apparatus of claim 1, further comprising means for ionizing the air stream.

16. The apparatus of claim 15, wherein said contacting means comprises a nozzle having an inlet for the pulsating air stream and an outlet for discharge of the pulsating air stream in such direction that the stream contacts the surface of the object, said ionizing means being installed in said nozzle.

17. The apparatus of claim 1, wherein the object is elongated, said supporting means comprising means for transporting the object lengthwise so as to maintain the surface of the object in a predetermined plane.

18. The apparatus of claim 1, wherein the object is stationary; and further comprising means for supporting the object so as to maintain the surface of the object in a predetermined plane.

* * * * *